US006148502A

United States Patent [19]

Gerber et al.

[11] Patent Number: 6,148,502

[45] **Date of Patent: *Nov. 21, 2000**

[54] SURFACE MOUNT RESISTOR AND A METHOD OF MAKING THE SAME

[75] Inventors: George V. Gerber, Bonita, Calif.; Joel J. Smejkal, Columbus, Nebr.

[73] Assignee: Vishay Sprague, Inc., Malvern, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/946,734

[22] Filed: Oct. 2, 1997

[51] Int. Cl.[7] ..... H01C 17/28

[52] U.S. Cl. ..... 29/621; 29/610.1; 29/619; 29/620; 338/195

[58] Field of Search ..... 29/621, 620, 611, 29/610.1, 558; 337/297, 232, 228, 227

[56] References Cited

U.S. PATENT DOCUMENTS

| | | | |
|---|---|---|---|
| 2,736,785 | 2/1956 | DuBois . | |
| 3,947,801 | 3/1976 | Bube . | |
| 4,146,673 | 3/1979 | Headley . | |
| 4,268,954 | 5/1981 | Sease et al. | 29/620 |
| 4,284,970 | 8/1981 | Berrin et al. . | |
| 4,352,005 | 9/1982 | Evans et al. . | |
| 4,429,298 | 1/1984 | Oberholzer . | |
| 4,529,958 | 7/1985 | Person et al. . | |
| 4,684,916 | 8/1987 | Ozawa . | |
| 5,166,656 | 11/1992 | Badihi et al. | 337/297 |
| 5,218,334 | 6/1993 | Bartlett . | |
| 5,287,083 | 2/1994 | Person et al. . | |
| 6,007,755 | 12/1999 | Hoshii et al. . | |

OTHER PUBLICATIONS

IBM Technical Disclosure Bulletin, Oct. 1979, Quick Trim High Aspect Ratio Resistor.

*Primary Examiner*—Lee Young
*Assistant Examiner*—Sean Smith
*Attorney, Agent, or Firm*—Zarley, McKee, Thomte, Voorhees & Sease

[57] ABSTRACT

An improved surface mount resistor and method for making the same includes a body comprised of an elongated strip of electrically resistive material and a resistor terminal formed at each end of the resistive material. The resistive material is machined with a laser beam to create a current path having a desired resistance. The pattern cut is determined by partitioning the resistive material into a plurality of squares forming a current path through the resistive material with the correct resistivity. The resistive material is cut primarily with axial cuts so that the beam strength of the resistive material is maintained.

7 Claims, 5 Drawing Sheets

SURFACE MOUNT RESISTOR AND A METHOD OF MAKING THE SAME

BACKGROUND OF THE INVENTION

1. Field of the Invention

The present invention relates to surface mount resistors. More particularly, it relates to current sense resistors using a metal element. Still more particularly, though not exclusively, the present invention relates to surface mount resistors having an increased mechanical strength.

2. Problems in the Art

Surface mount resistors have been produced in the electronics industry. Their construction has typically been comprised of a flat rectangular resistive metal strip with high conductivity metal terminals welded to the ends of the resistive metal strip to form the electrical termination points. The resistive metal strip may be "adjusted" to a desired resistance value by abrading or by using a laser to remove some of the resistive material. A protective coating, for example epoxy, is then applied over the resistive material to provide protection from various environments to which the resistor may be exposed as well as providing strength to the resistor.

Typical prior art resistors are adjusted to a desired resistance by making lateral plunge cuts from the sides of the resistor material making a serpentine-type pattern. While these plunge cuts result in a resistor with a desired resistance, the lateral cuts across the face of the resistor degrade the mechanical strength of the device, in particular, the beam strength of the device. In some applications, it is desirable to put a physical load on the resistor across the face of the resistive metal. With the prior art employing lateral plunge cuts across the resistive metal, substantially all of the structural strength comes from the epoxy coating rather than the resistive metal. Therefore, it can be seen that there is a need for an improved surface mount resistor having an increased beam strength while still allowing the resistance of the resistor to be adjusted.

FEATURES OF THE INVENTION

A general feature of the present invention is the provision of an improved surface mount resistor and method for making the same which overcomes problems found in the prior art.

A further feature of the present invention is the provision of an improved surface mount resistor and method for making the same having a resistance determined by a pattern of intervening squares.

A further feature of the present invention is the provision of an improved surface mount resistor and method for making the same having a resistance generated with a series of axial cuts in the resistive material.

Further features, objects and advantages of the present invention include:

An apparatus and method for an improved surface mount resistor which utilizes a metal resistant strip or metal resistant film to achieve very low resistance values and high resistant stability.

An apparatus and method for an improved surface mount resistor which has a resistance value determined by the number of square patterns in the current path of the resistor.

An apparatus and method for an improved surface mount resistor which has an increased beam strength as a result of a carefully selected pattern including primarily axial cuts rather than lateral cuts.

An apparatus and method for an improved surface mount resistor which can have a wide array of possible values depending on the pattern of intervening squares generated on the resistor.

An apparatus and method for an improved surface mount resistor which incorporates all of the above features and maintains a surface mount design.

An apparatus and method for an improved surface mount resistor which is economical in manufacture, durable in use, and efficient in operation.

An apparatus and method for an improved surface mount resistor which is easily solderable on a surface mount board.

These as well as other objects, features and advantages will become apparent from the following specification and claims.

SUMMARY OF THE INVENTION

The improved surface mount resistor of the present invention is comprised of a piece of resistive material and two conductive metal pieces metallurgically bonded to the edges of the resistive material. A current path is formed through the resistive material between the conductive metal pieces. Any necessary lateral cuts are restricted to the ends where the beam bending moment is minimal. The current path is formed by making primarily axial cuts into the resistive material such that the beam strength of the resistive material is substantially maintained. The current path may optionally be formed by a plurality of squares where the number of squares determines the resistivity of the surface mount resistor.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
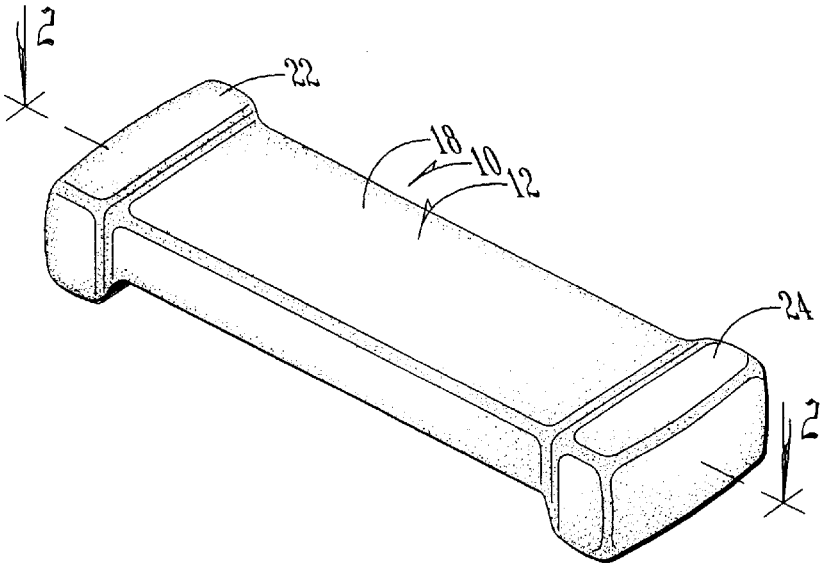
FIG. 1 is a perspective view of a surface mount resistor according to the present invention.
Figure 2:
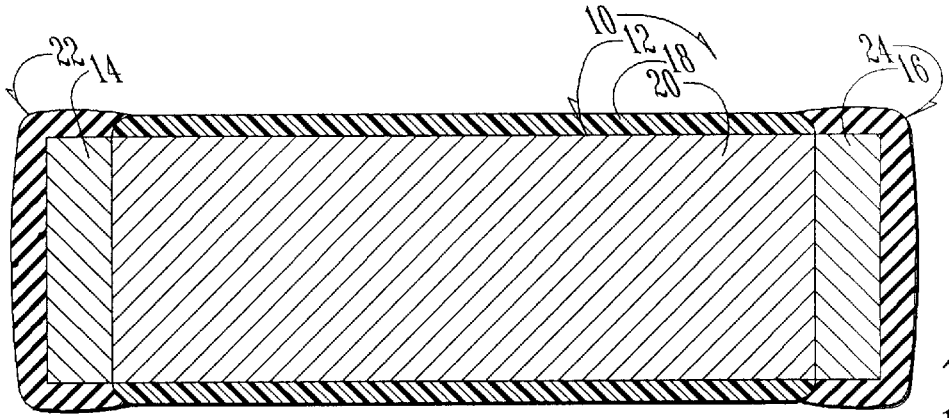
FIG. 2 is a sectional view from above taken along line 2—2 in FIG. 1.

FIGS. 1 and 2 show the preferred embodiment of the present invention. Referring to FIGS. 1 and 2, an electrical surface mount resistor 10 is shown and includes a body 12 and first and second terminals 22 and 24. The first and second conductive terminals 22 and 24 are welded or electroplated to the ends of the resistor body 12. An insulative material 18 is coated or molded around and encapsulates the resistor body 12. The insulated material 18 is preferably comprised of epoxy or any other suitable material.

FIG. 2 is a cross section of the resistor 10 shown in FIG. 1 viewing the resistor 10 from above. As shown in FIG. 2, the body 12 includes a resistive material 20 which is preferably comprised of nickel or copper alloy metals. At opposite ends of the resistive material 20 are terminal pads 14 and 16. The terminal pads 14 and 16 are electrically conductive and are metalurgically bonded to the terminals 22 and 24 creating a current path between the first and second terminals 22 and 24 through the resistive material 20. Note that FIG. 2 shows the resistor 10 without the resistance adjusted by machining the resistive material 20 (described below). Preferably, the terminal pads 14 and 16 have a height that is greater than the height of the body 12 which creates "standoffs". As a result, the body 12 of the resistor 10 will be spaced from the circuit board to which it is mounted and therefore will not contact the circuit board. FIG. 1 best shows the formation of the standoffs on the underside of the resistor 10.

In constructing the resistor 10, the following steps are used. Initially the resistive material 20 is formed into the rectangular shape shown in FIGS. 1 and 2. The resistance material 20 typically has a thickness 1–14 mills, depending on the resulting resistance which is desired for the completed resistor 10. Of course, the thickness of the resistive material 20 can vary within the scope of the invention. In the next step, the resistive material 20 can be machined or cut to form a current path through the resistive material 20 and resulting in a resistance which depends on the pattern cut. The preferred method of machining the resistive material 20 is by the use of a laser. This process is described in detail below. At the ends of the resistive material 20 are high conductivity metallic pads 14 and 16 which will have electroplated, solderable coatings 22 and 24. The resistive material 20 is coated by coating material 18 and the terminals 22 and 24 are formed by applying a conductive material over the metallic pads 14 and 16.

Figure 3:
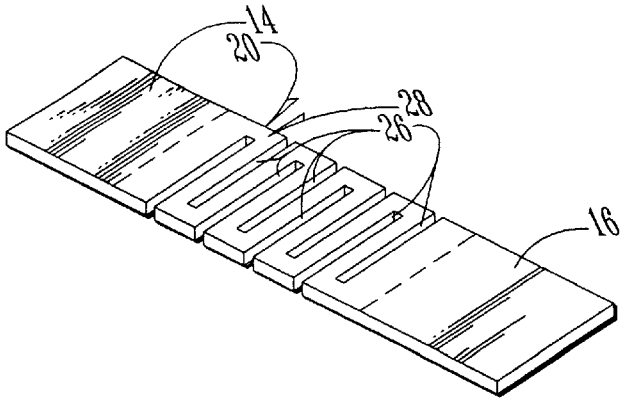
Fig. 3 (PRIOR ART)
FIG. 3 is a perspective view showing the pattern cut in the resistive material of a typical prior art surface mount resistor.

FIG. 3 shows a pattern cut in the resistive material 20 in a prior art resistor. In the prior art, the resistance of the resistor is increased to a desired resistance value by cutting alternative plunge cuts 26 through the resistive material 20 to form a serpentine current path 28. Since the plunge cuts 26 weaken the axial rigidity of the resistive material 20, the resistance material 20 is encapsulated by an epoxy material (not shown in FIG. 3) for strength and electrical isolation. As can be seen in FIG. 3, the plunge cuts 26 significantly weaken the beam strength of the resistor. It can also be seen that no elongated portions of the resistive material 20 span the length of the resistor.

The present invention provides an improvement over the prior art by carefully selecting the pattern machined in the resistive material 20. The resistance value of the resulting resistor can be precisely selected by understanding the resistive properties of the resistive material 20. A resistive material having a uniformly flat shape, will have a certain resistance per square, regardless of the size of the square. For example, if the resistive material 20 has a resistance of 2 mΩ per square, then the resistance of a resulting resistor 10 will have a value depending on how many squares are in the current path from the first conductive pad 14 to the second conductive pad 16. For example, if a 6 mΩ resistor is desired, the current path through the resistive material 20 should be comprised of three squares of any size. To assist in the understanding of why the resistance is the same for any size square, an illustration follows. If a given square has a resistance of 2 mΩ for example, and the square is divided in half in two directions, four identical squares are created with an overall combined resistance of 2 mΩ. It can be seen that the upper two squares will have a series resistance of 4 mΩ. The lower two squares will have the same series resistance (4 mΩ). Taking the parallel combination of the upper and lower resistances (4 mΩ and 4 mΩ) results in a resistance of 2 mΩ. It can therefore be seen that a square of any size will have a resistance of 2 mΩ assuming that everything else stays constant, for example the thickness of the material and the resistivity of the material.

FIGS. 4–27 illustrate various embodiments of the present invention. As shown, a wide variety of resistance values can be obtained by choosing an appropriate pattern of squares. In all of the examples, the beam strength of the surface mount resistor 10 is significantly greater than with the prior art resistor shown in FIG. 3. In the examples shown in the Figures, there is at least one portion of the resistive material 20 that spans a significant amount of the length of the resistive material, in contrast to the prior art resistor shown in FIG. 3. In the examples shown, the resistive material 20 has a resistance of 2 mΩ per square (of any size). Of course, by varying the thickness of the material or the type of material, the resistance per square could take on any value. In the examples shown in FIGS. 4–27, the cuts machined through the resistive material 20 are greatly exaggerated to more clearly illustrate the examples. In actuality, if the cuts are made with a laser, for example, the kerf of the laser cut will be approximately 3–5 mills. As a result of the exaggerated width of the cuts shown in the drawings, some of the squares in the figures may not appear to be exact squares. However, since the width of the cuts are actually 3–5 mills, the patterns shown in the figures are comprised of all squares.

Figure 4:
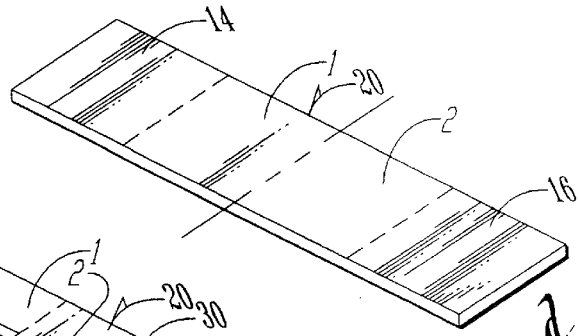
FIGS. 4–27 are perspective views showing various examples of patterns in the resistive material in resistors of the present invention.

FIG. 4 shows a resistor having a current path consisting of two squares, therefore having total resistance of 4 mΩ. In this example, no cuts have been made to the resistive material 20.

Figure 5:
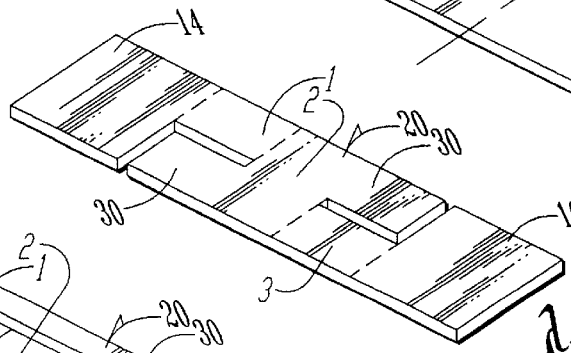

FIG. 5 shows a resistor having a current path consisting of three squares, therefore having a total resistance of 6 mΩ. As shown, only two lateral cuts are made in the resistive material 20, therefore increasing the beam strength of the resistor over the prior art. The resistive material 20 shown in FIG. 5 includes portions 30 which do not contribute to the resistivity of the resistor, but do contribute to the beam strength of the resistor.

Figure 6:
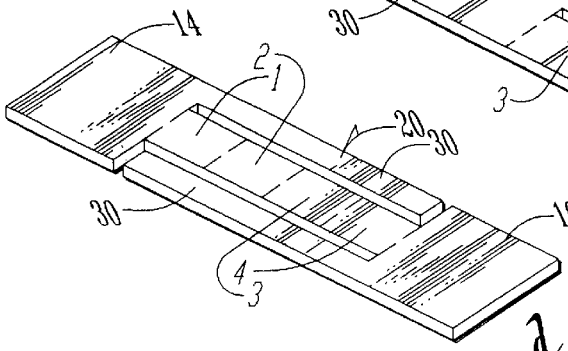

FIG. 6 shows a resistor having a current path consisting of four squares, therefore having a total resistance of 8 mΩ. As shown, only two lateral cuts are made at the ends of the resistive material 20, therefore increasing the beam strength over the prior art. The resistive material 20 in FIG. 6 also includes portions 30 which do not contribute to the resistivity of the resistor, but do contribute to its beam strength.

Figure 7:
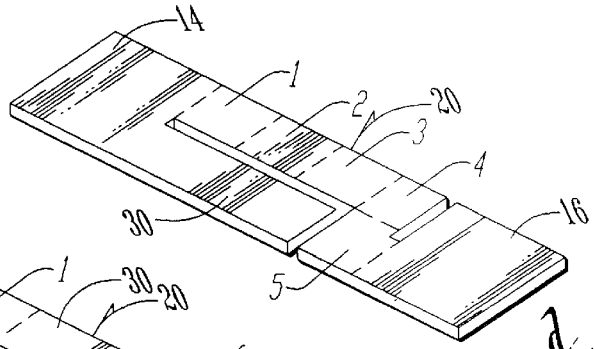

FIG. 7 shows a resistor having a current path consisting of five squares, therefore having a total resistance of 10 mΩ. Again, only two lateral cuts are made at or near the ends of the resistive material 20, therefore increasing the beam strength of the resistor over the prior art. The resistive material shown in FIG. 7 includes a portion 30 which does not contribute to the resistivity of the resistor, but does contribute to its bean strength.

Figure 8:
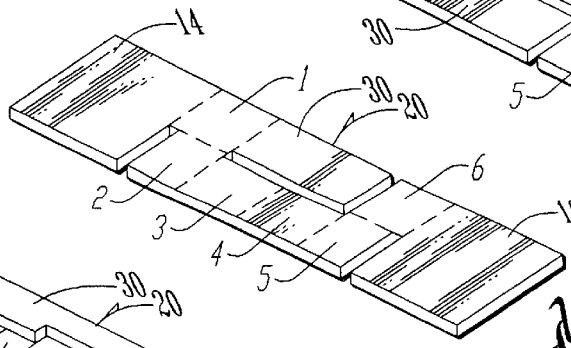

FIG. 8 shows a resistor having a current path consisting of six squares, therefore having a total resistance of 12 mΩ. In this example, only three lateral cuts are made in the resistive material 20, therefore increasing the beam strength of the resistor over the prior art. Again, the resistive material 20 includes a portion 30 which does not contribute to the resistivity of the resistor but does contribute to its beam strength.

Figure 9:
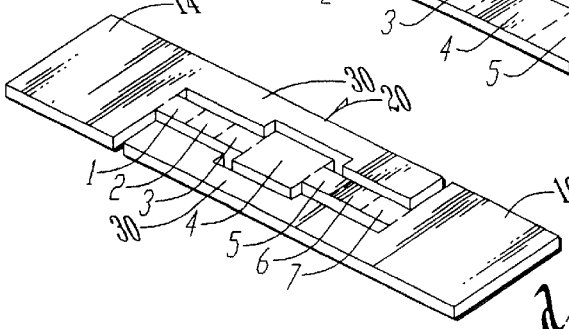

FIG. 9 shows a resistor having a current path consisting of seven squares, therefore having a total resistance of 14 mΩ. As shown, the first three and last three squares are the same size while the fourth square is twice as long and twice as wide as the other squares. Again, the lateral cuts through the resistive material 20 are kept at a minimum, therefore increasing the beam strength compared to the prior art. The resistive material 20 in FIG. 9 also includes portions 30 which do not contribute to the resistivity of the resistor but do contribute to its beam strength.

Figure 10:
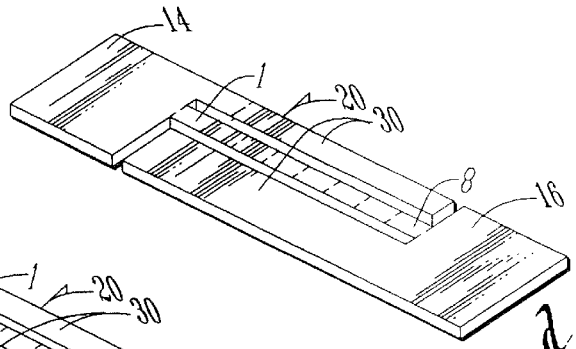
Figure 11:
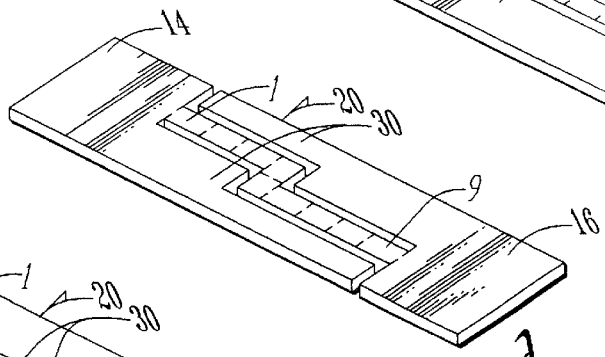
Figure 12:
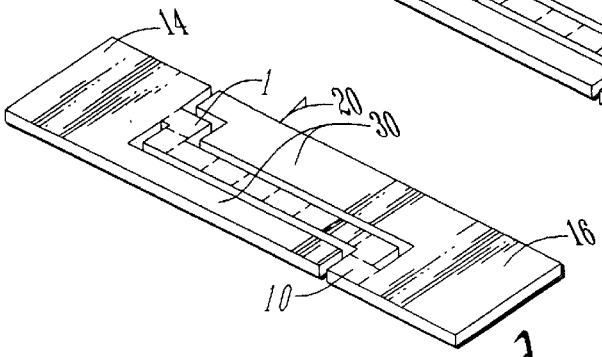
Figure 13:
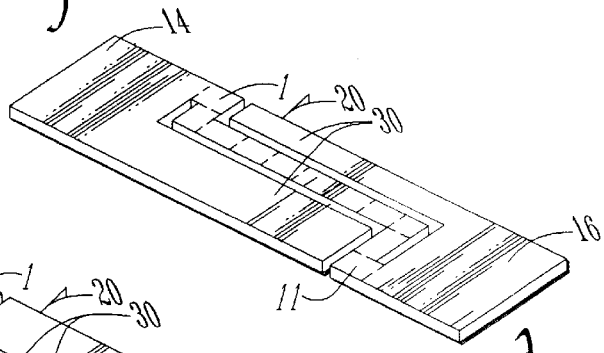
Figure 14:
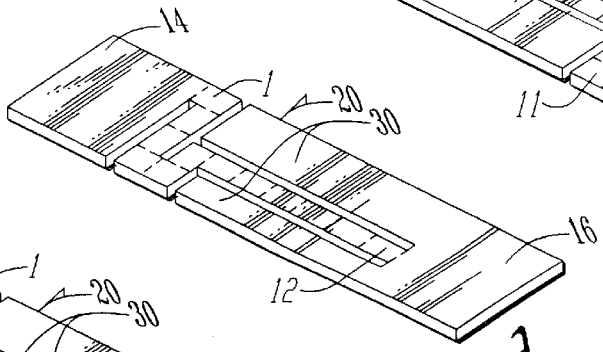
Figure 15:
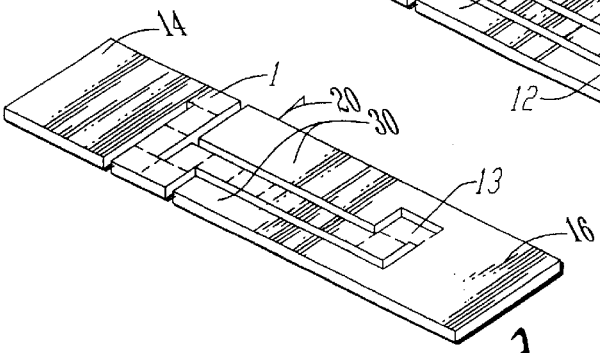
Figure 16:
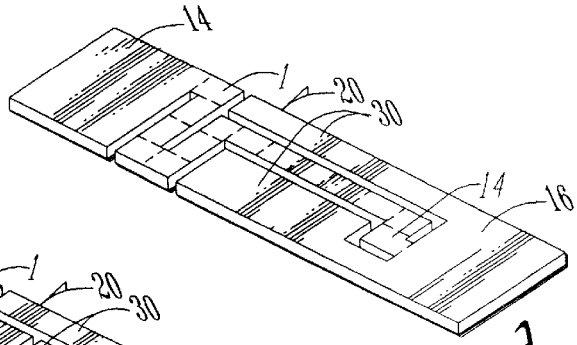
Figure 17:
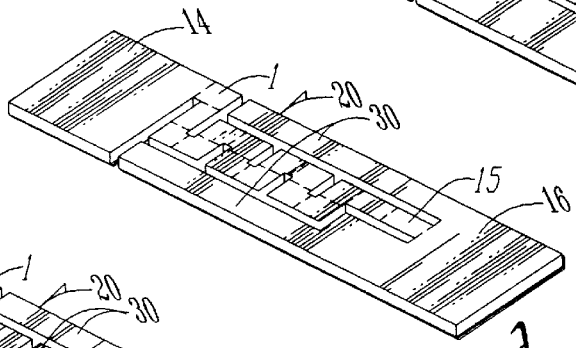
Figure 18:
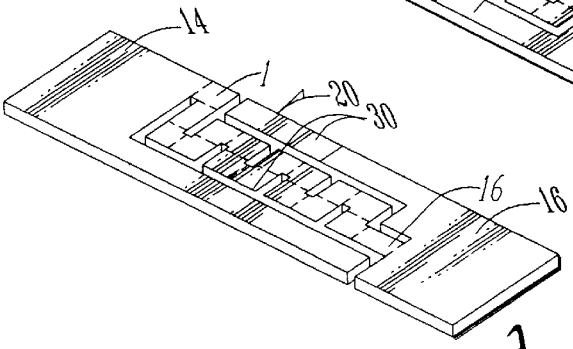
Figure 19:
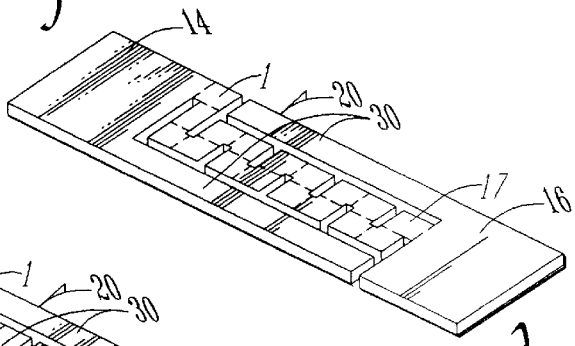
Figure 20:
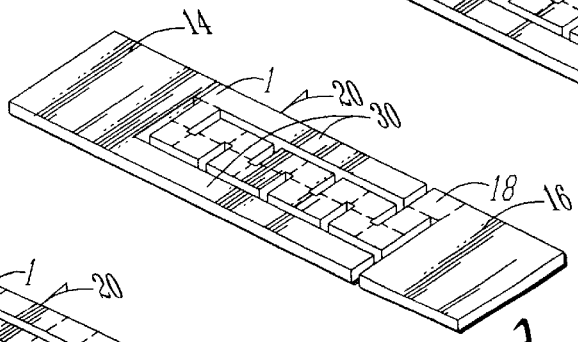
Figure 21:
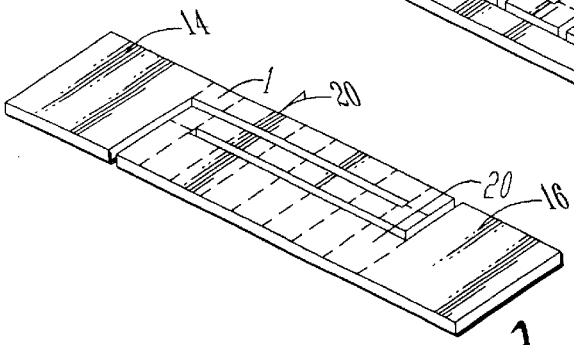
Figure 22:
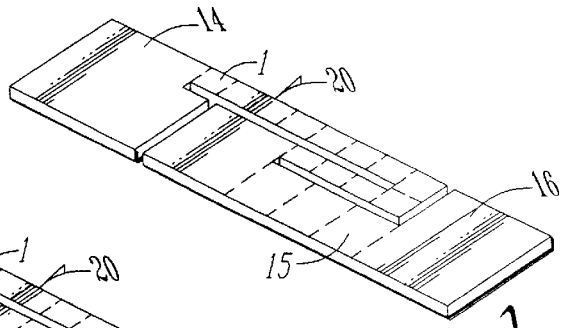
Figure 23:
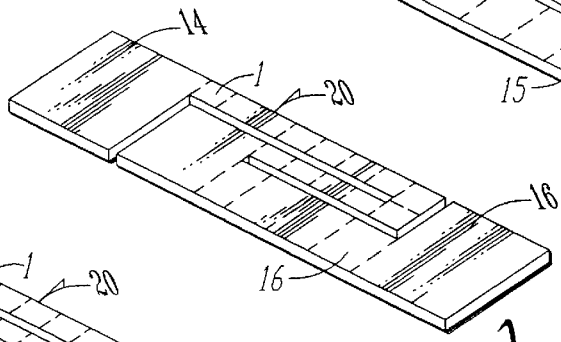
Figure 24:
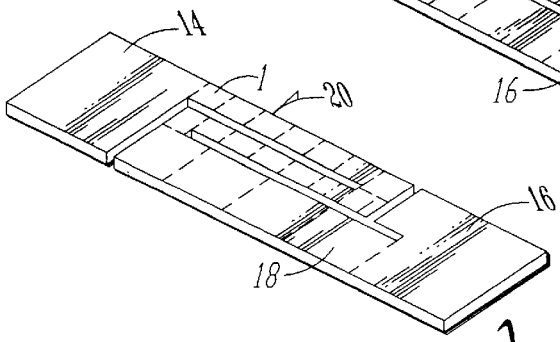
Figure 25:
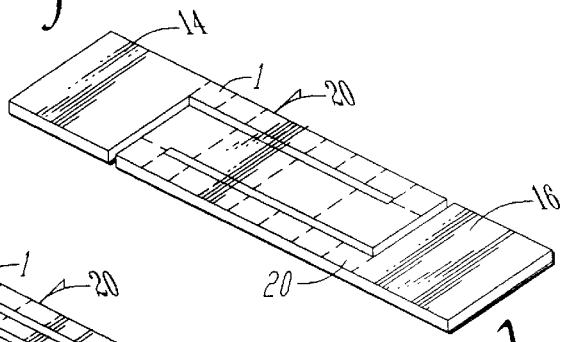
Figure 26:
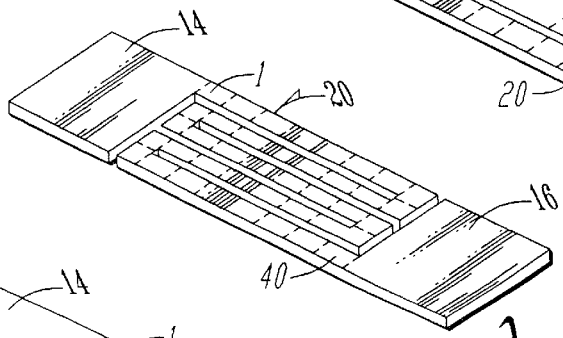
Figure 27:
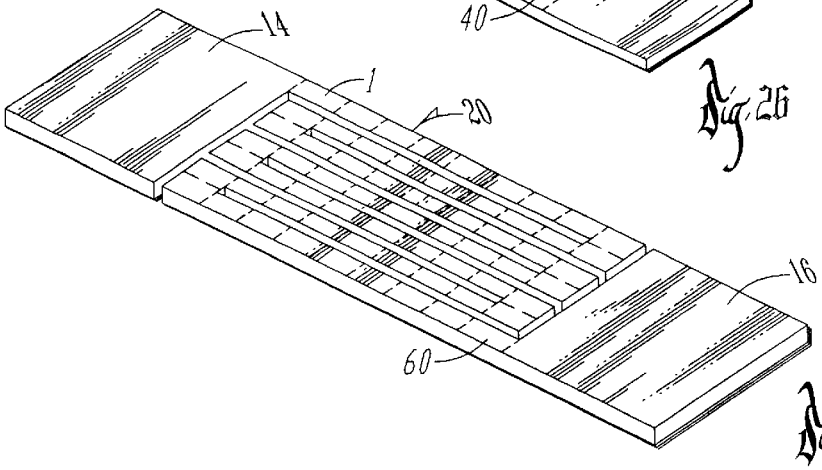

FIGS. 10–20 show resistors having current paths consisting in a number of squares having the same size. The only difference between the embodiments shown in FIGS. 10–20 is the selected current path. As shown in FIG. 10, the current path consists of eight squares, therefore having a total resistance of 16 mΩ. FIG. 11 shows a resistor having a current path consisting of nine squares, therefore having a total resistance of 18 mΩ. FIG. 12 shows a resistor having a current path consisting of ten squares, therefore having a total resistance of 20 mΩ. FIG. 13 shows a resistor having a current path consisting of eleven squares, therefore having a total resistance of 22 mΩ. FIG. 14 shows a resistor having a current path consisting of twelve squares, therefore having a total resistance of 24 mΩ. FIG. 15 shows a resistor having a current path consisting of thirteen squares, therefore having a total resistance of 26 mΩ. FIG. 16 shows a resistor having a current path consisting of fourteen squares, therefore having a total resistance of 28 mΩ. FIG. 17 shows a resistor having a current path consisting of fifteen squares, therefore having a total resistance of 33 mΩ. FIG. 18 shows a resistor having a current path consisting of sixteen squares, therefore having a total resistance of 32 mΩ. FIG. 19 shows a resistor having a current path consisting of seventeen squares, therefore having a total resistance of 34 mΩ. FIG. 20 shows a resistor having a current path consisting of eighteen squares, therefore having a total resistance of 36 mΩ. In all of the FIGS. 10–20, the resistive material 20 includes portions 30 which do not contribute to the resistivity of the resistor but do contribute to its beam strength. The remaining FIGS. 21–27 have current paths consisting of a number of squares, some of which have differing sizes. For example, as shown in FIG. 21, the current path consists of 20 squares resulting in a resistance of 40 mΩ. As shown, there are two rows of eight squares and one row of four squares where the four squares are twice as big as the first sixteen. FIGS. 22–25 show resistors having alternate current paths consisting of 15, 16, 18, and 20 squares, respectively. FIG. 26 shows a resistor having a current path consisting of 40 squares. FIG. 27 shows an enlarged view of a resistor having a current path consisting of 60 squares.

As can be seen in this example, a specific resistance can be obtained by specifying the appropriate number of squares and creating a current path on the resistive material 20 comprised of the appropriate number of squares. At the same time, the beam strength of the resistor is substantially maintained by limiting the amount of lateral cuts in the resistive material 20. In the example shown in the figures, a range of resistivity of 4–120 mΩ is obtainable by selecting the appropriate pattern for the current path. Of course other ranges are possible within the scope of the invention. In addition, for any number of squares there are a number of possible ways to lay out the current path on the resistive material 20. The examples in the Figures are just a few of the possible patterns. Also, a combination of other shapes may be used, for example, half-squares, rectangles, etc. Other configurations are also possible with the present invention. For example, if desired, both terminals of the resistor could be located on the same side of the resistor. With the prior art method of adjusting the resistance, this would not be possible.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope Of the invention as further defined in the following claims.

What is claimed is:

1. A method for making a surface mount resistor comprising:

forming a rectangular piece of resistance material having first and second opposite ends, first and second opposite sides, a longitudinal axis extending between said first and second opposite ends, and a uniform thickness, whereby said rectangular piece of resistance material has a predetermined resistance per square regardless of the size of said square;

placing first and second conductive terminals on said first and second ends respectively of said rectangular piece so as to create an initial current path having an initial number of squares between said first and second terminals;

cutting no more than three plunge cuts in said rectangular piece, each commencing adjacent one of said first and second opposite sides of said rectangular piece and each having at least a portion thereof extending in a direction transverse to said longitudinal axis of said rectangular piece;

cutting two or more longitudinal cuts in said rectangular piece, each of said longitudinal cuts extending in a direction parallel to said longitudinal axis of said rectangular piece and communicating with only one of said plunge cuts;

choosing the locations of said plunge cuts and said longitudinal cuts to maximize the beam strength of said rectangular piece between said first and second terminals while at the same time creating a single resulting current path between said first and second terminals having a resulting total number of squares at least twice that of said initial total number of squares between said first and second terminals.

2. A method according to claim 1 and further comprising continuing to limit the number of said plunge cuts to no more than three, and choosing the locations of said plunge cuts and said longitudinal cuts to create said single resulting current path between said first and second terminals with a resulting total number of squares at least three times that of said initial total number of squares between said first and second terminals.

3. A method according to claim 1 and further comprising continuing to limit the number of said plunge cuts to no more than three, and choosing the locations of said plunge cuts and said longitudinal cuts to create said single resulting current path between said first and second terminals with a resulting total number of squares at least four times that of said initial total number of squares between said first and second terminals.

4. A method according to claim 1 and further comprising continuing to limit the number of said plunge cuts to no more than three, and choosing the locations of said plunge cuts and said longitudinal cuts to create said single resulting current path between said first and second terminals with a resulting total number of squares at least five times that of said initial total number of squares between said first and second terminals.

5. A method according to claim 1 and further comprising continuing to limit the number of said plunge cuts to no more than three, and choosing the locations of said plunge cuts and said longitudinal cuts to create said single resulting current path between said first and second terminals with a resulting total number of squares at least six times that of said initial total number of squares between said first and second terminals.

6. A method according to claim 1 and further comprising continuing to limit the number of said plunge cuts to no more than three, and choosing the locations of said plunge cuts and said longitudinal cuts to create said single resulting current path between said first and second terminals with a resulting total number of squares from two to thirty times that of said initial total number of squares between said first and second terminals.

7. A method according to claim 1 wherein said step of cutting said longitudinal cuts further comprises making the lengths of said longitudinal cuts greater than one-half of the distance between said first and second terminals.

* * * * *